US005615651A

United States Patent [19]

Miyachi

[11] Patent Number: 5,615,651

[45] Date of Patent: Apr. 1, 1997

[54] VALVE GEAR DEVICE FOR INTERNAL COMBUSTION ENGINES

[75] Inventor: Eiji Miyachi, Aichi-ken, Japan

[73] Assignee: Aisin Seiki Kabushiki Kaisha, Aichi-pref., Japan

[21] Appl. No.: 565,106

[22] Filed: Nov. 30, 1995

[30] Foreign Application Priority Data

Nov. 30, 1994 [JP] Japan ..... 6-297456

[51] Int. Cl.[6] ..... F01L 13/00; F02D 13/06

[52] U.S. Cl. ..... 123/198 F; 123/90.16; 123/90.48

[58] Field of Search ..... 123/90.15, 90.16, 123/90.48, 198 F

[56] References Cited

U.S. PATENT DOCUMENTS

| | | | |
|---|---|---|---|
| 4,770,137 | 9/1988 | Okabe et al. | 123/198 F |
| 5,343,833 | 9/1994 | Shirai | 123/90.16 |
| 5,361,734 | 11/1994 | Shirai | 123/90.16 |
| 5,415,137 | 5/1995 | Paul | 123/90.16 |
| 5,431,133 | 7/1995 | Spath et al. | 123/90.16 |
| 5,488,934 | 2/1996 | Shirai et al. | 123/90.16 |

FOREIGN PATENT DOCUMENTS 5-36605 5/1993 Japan .

*Primary Examiner*—Weilun Lo
*Attorney, Agent, or Firm*—Hazel & Thomas, P.C.

[57] ABSTRACT

A valve gear device for internal combustion engines incorporates a stem connected to an intake and exhaust valve which opens or closes an intake bore or exhaust bore opening in a combustion chamber of an internal combustion engine; a first spring which urges the stem toward the direction of blocking the intake and exhaust valve; a cam supported around a cam shaft; and a valve deactivating mechanism provided between the cam and the stem. The valve deactivating mechanism includes a first movable member which is movable toward the axial direction of the intake and exhaust valve in the bore formed in a cylinder head of the internal combustion engine; a relative movement regulating device which moves so as to cross the axis center of the stem so that the first movable member and the stem are released and engaged and which regulates or allows the relative movement between the first movable member and the stem; an oil pressure supplying and exhausting device which supplies and exhausts the oil pressure to the relative movement regulating device so that the relative movement regulating device moves; a valve which prevents the oil pressure from being supplied to the relative movement direction between the first movable member and the stem is dead center of one of the switching ones. When the relative movement regulating device is able to be engaged, the oil pressure supplying and exhausting means is activated.

4 Claims, 4 Drawing Sheets

VALVE GEAR DEVICE FOR INTERNAL COMBUSTION ENGINES

BACKGROUND OF THE INVENTION

1. Field of the Invention

The present invention relates to a valve gear device for internal combustion engines which has a valve stopping mechanism for stopping or deactivating an intake or exhaust valve continuously.

2. Description of the Prior Art

As a conventional example of a valve gear device for internal combustion engines of this kind, Japanese Examined Patent Publication (KOKOKU) No. 5-36605 has been known. This conventional device comprises: a valve stem connected to an intake or exhaust valve for opening and closing an intake (exhaust) hole which opens in a combustion chamber of an engine; a cam which is provided on a cam shaft; and a valve deactivating mechanism which is provided between the cam and the valve stem and which can keep the intake or exhaust valve in the closed condition. This valve deactivating mechanism includes: a body which is provided in a cylinder head and which is provided slidably in the axial direction of the intake or exhaust valve; a body hole which is formed in the body and which has an axial center that is perpendicular to the axial center of a stem; and a plunger having a stem pull-in and pull-out hole which extends toward the direction of the axial center of the body hole and the stem. In this valve deactivating mechanism, when the oil pressure is applied to the plunger, the stem is engaged into the stem pull-in and pull-out hole of the plunger so that the plunger and the stem can be moved relative to each other. Therefore, even if the cam is rotated, the torque thereof is not transmitted to the stem so that the intake or exhaust valve is kept in the closed condition. When the oil pressure is not applied to the plunger, the plunger engages the stem, and the plunger and the stem are moved together. Therefore, together with the rotation of the cam, the intake or exhaust valve is opened or closed.

The above-mentioned conventional device has the following disadvantages: the stem of the plunger engaging with the stem pull-in and pull-out hole is accomplished by supplying oil pressure to one end portion of the plunger and displacing the plunger so as to intersect the axial center of the stem. However, the timing of this displacement is not considered. Accordingly, the function of the valve gear device itself may not be impaired, but the engagement of the stem into the stem pull-in and pull-out hole of the plunger may be delayed. At that moment, the stem may collide with the other portion so that some noise may be generated. Furthermore, in order to endure such a collision, the materials of the plunger and the stem should be selected from the materials having high durability, and consequently a higher cost.

SUMMARY OF THE INVENTION

It is, therefore, an object of the present invention to provide an improved valve gear device for internal combustion engines which overcomes the above disadvantages.

In order to achieve the objective, there is provided a valve gear device for internal combustion engines that includes: a stem connected to an intake or exhaust valve which opens or closes an intake hole or exhaust hole opening in a combustion chamber of an internal combustion engine; urging means which urges the stem so as to close the intake or exhaust valve; a cam supported around a cam shaft; and a valve deactivating mechanism provided between the cam and the stem, wherein the valve deactivating mechanism comprises a movable member movable toward the axial direction of the intake or exhaust valve in the hole formed in a cylinder head of the internal combustion engine and which moves so as to cross the axial center of the stem so that the movable member and the stem are disengaged from or engaged with each other and which prohibits and allows the relative movement between the movable member and the stem; an oil pressure supplying and discharging means which supplies or discharges the oil pressure to or from the relative movement regulating means so that the relative movement regulating means is moved; a valve means which prevents the oil pressure from being supplied to the relative movement regulating means while the movable member is downwardly moved relative to the stem.

In the above-mentioned valve gear device, the valve means prevents oil from being supplied when the movable member and the stem can be engaged. When the movable member and stem are in the relative position in which they cannot be engaged with each other, the valve means allows oil to be supplied to the relative movement regulating means so that the relative movement regulating means is urged so as to intersect the axial center of the stem. Then, when the movable member and the stem are in the relative position in which they can be engaged each other, the relative movement regulating means crosses the stem by the oil pressure so that relative movement of the movable member and the stem is prohibited. Accordingly, this regulation can be conducted at the appropriate time.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENT

Having generally described the present invention, a further understanding can be obtained by reference to the specific preferred embodiment which is provided herein for purposes of illustration only and are not intended to limit the scope of the appended claims.

Preferred Embodiment

Figure 1:
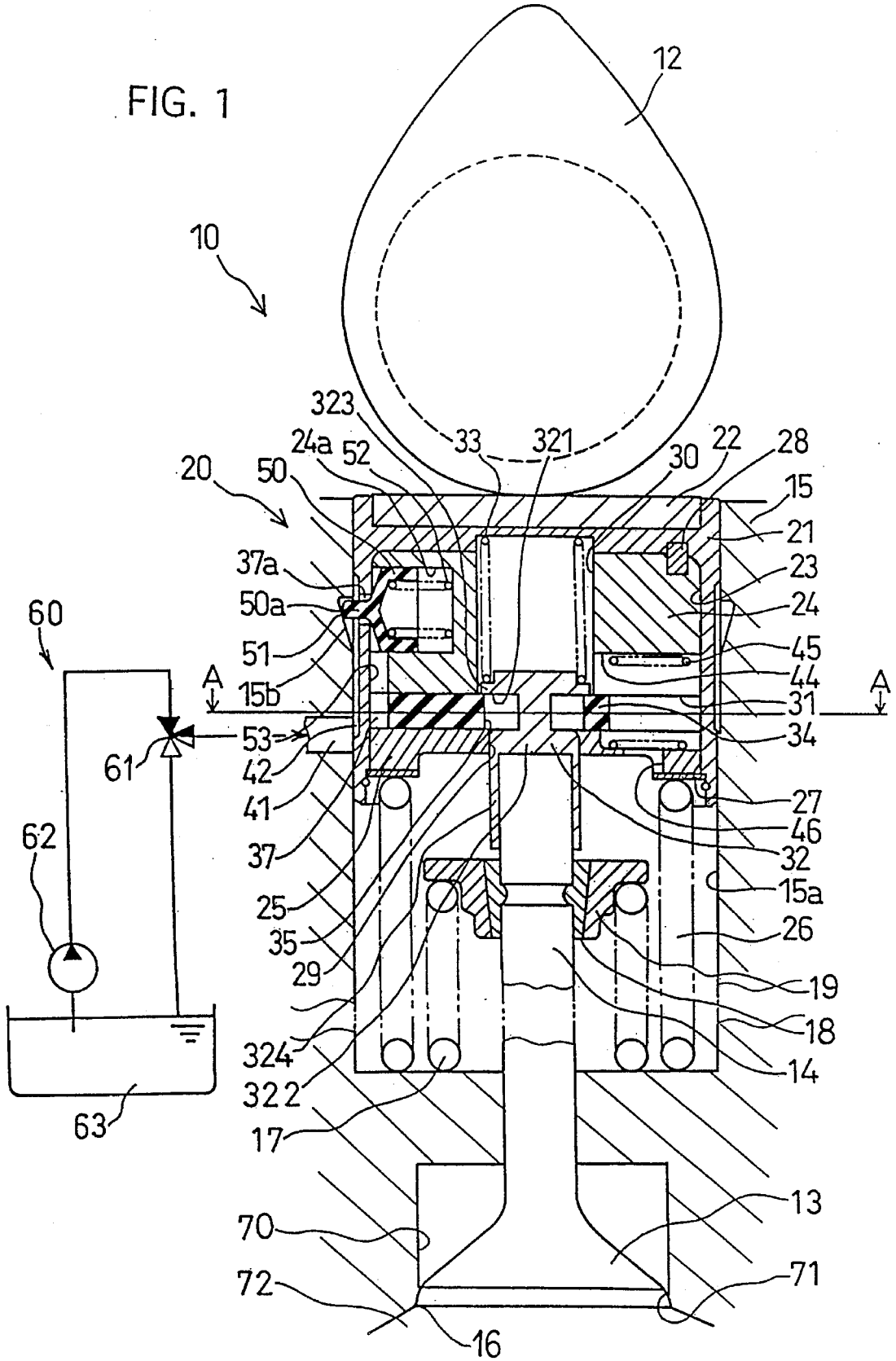
FIG. 1 is a cross sectional view showing the valve gear device (at the operating mode of the intake or exhaust valve) for internal combustion engines of a Preferred Embodiment of the present invention.
Figure 5:
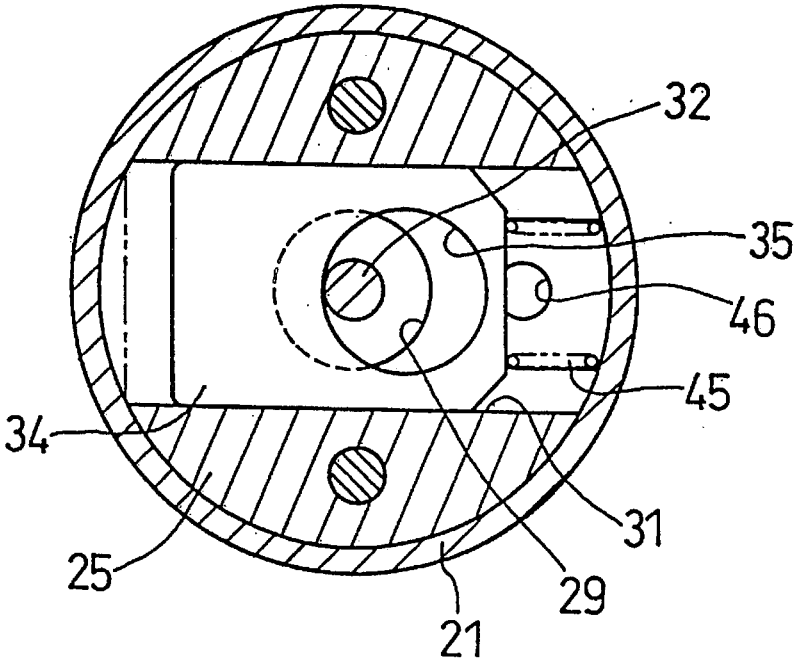
FIG. 5 is a B to B cross sectional view of FIG. 4.
Figure 4:
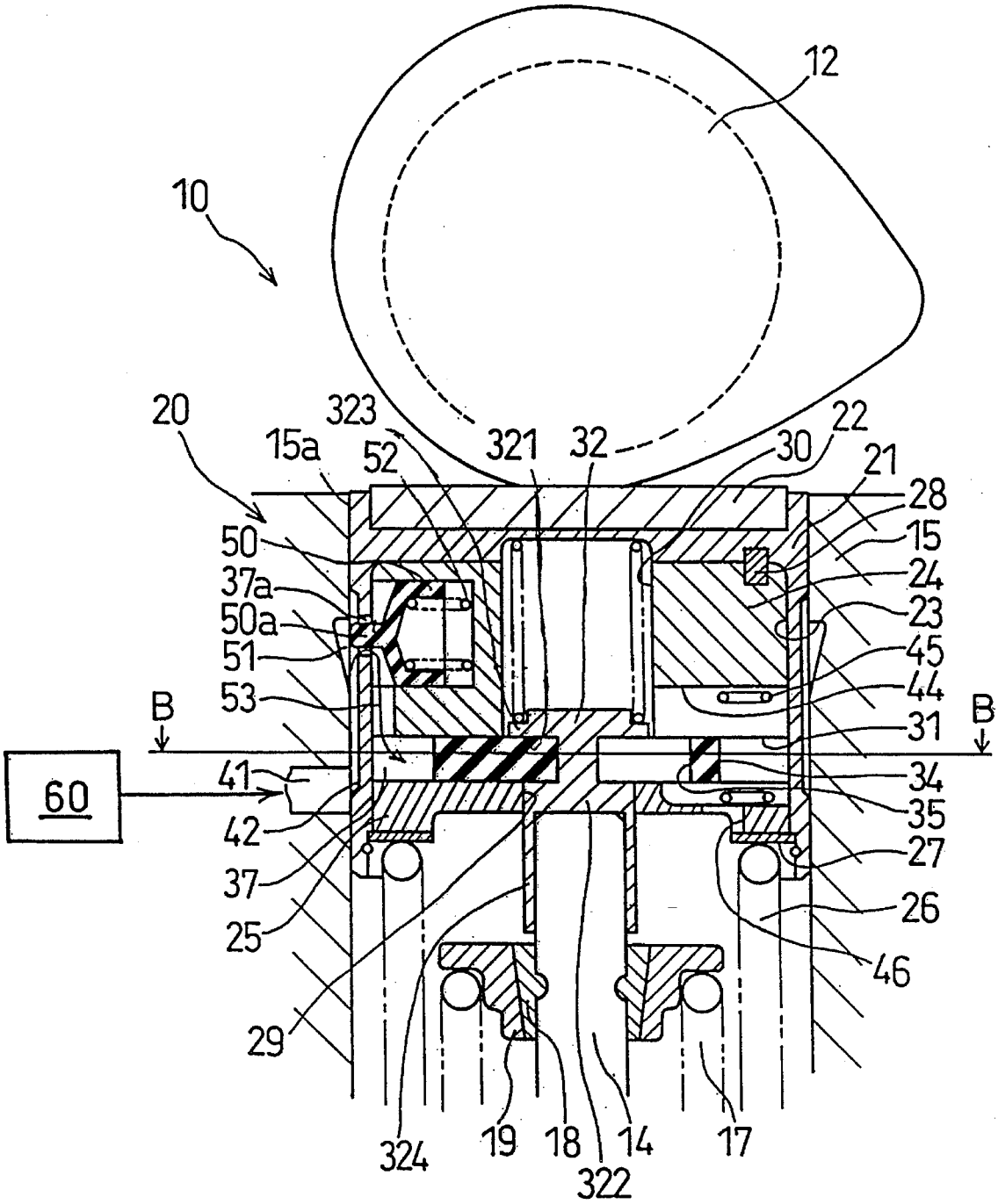
FIG. 4 is a cross sectional view showing the valve gear device (at the resting mode of the intake or exhaust valve) for internal combustion engines of the Preferred Embodiment of the present invention.

The valve gear device 10 of one preferred embodiment of the present invention will be explained based on FIG. 1 or FIG. 4 as follows. FIG. 1 or FIG. 4 shows the valve gear device for an internal combustion engine at the operating mode (opening and closing mode) of the intake or exhaust valve. FIG. 5 shows the valve gear device for an internal combustion engine at the resting mode (stopping mode) of the intake or exhaust valve.

The valve gear device 10 for an internal combustion engine shown in FIG. 1 comprises a cam 12 provided on a cam shaft 11; a valve stem (stem) 14 connected to an intake or exhaust valve 13 which opens and closes intake bore or an exhaust bore 70 opening into an engine combustion chamber 72 by contacting or separating to or from a sheet surface 71 formed on a cylinder head of the internal combustion engine; a valve spring (a first spring) 17 whose end is engaged to a retainer 19 fixed on the outer periphery of the valve stem 14 through cotter 18 and which urges the valve stem toward the direction of closing an intake or exhaust valve 13; and a valve deactivating mechanism 20 which is provided between the cam 12 and the valve stem 14. The valve stem 14 is made of heat resistant material (for example, heat resistant steel).

In the valve deactivating mechanism 20: a cylinder bore 15*a* is formed in the cylinder head 15 of the engine so as to extend toward the axial direction of the intake or exhaust valve 13. In this cylinder head bore 15*a*, a cylindrical outer body 21 is slidably disposed. On the upper surface of the outer body 21, an outer shim 22 having an engaging surface with the cam 12 is provided. This outer shim 22 adjusts the clearance between the base circle of the cam 12 and the valve deactivating mechanism 20. The outer diameter of this outer shim 22 is slightly smaller than the inner diameter of the cylindrical portion which is formed at the upper surface of the outer body 21 and which has the larger inner diameter. It may be possible to insert the outer shim 22 into the cylinder bore 15*a* without providing the cylindrical portion at the upper surface of the outer body 21. In this case, the outer diameter of the outer shim 22 may be slightly smaller than the diameter of the cylinder bore 15*a*.

In the inner space 23 of the outer body 21, two inner bodies 24 and 25 which are divided above and below are provided so as to be able to move with the outer body 21 together. Between the lower side inner body 25 and the base of the cylinder bore 15*a*, a spring 26 (a fourth spring) is provided and urges both of inner bodies 24 and 25 so as to press onto the outer body 21 (namely, the direction of closing the intake and exhaust valve. Between the spring 26 and the lower side inner body 25, a spring receiving seat 27 is provided. The upper side inner body 24 is supported being able to rotate relative to the outer body 21 through a detent pin 28. At the lower side inner body 25, a first slider guide hole 29 whose axial center corresponds to the axial center of the valve stem 14 is formed. And at the upper side inner body 24, a second slider guide bore 30 whose axial center corresponds to the axial center of the valve stem 14 and whose diameter is larger than the diameter of the first slider guide bore 29 is formed. Furthermore, between both of the inner bodies 24 and 25, a body bore 31 is defined with an axial center that crosses the axial center of the valve stem 14 at a right angle such that between the first and second slider guide bores 29 and 30, they cross each other. The above-mentioned outer body 21 and inner bodies 24 and 25 comprise the body of the present invention. Furthermore, the above-mentioned inner body 24 and the inner body 25 are composed of separate members, both of these bodies are connected to each other by a pair of pins 52 and the body bore 31 is formed between these bodies.

In the first and second slider guide bores 29 and 30: a slider 32 is guided movably so as to contact with the valve stem 14 constantly. This slider 32 is urged toward the direction of opening the intake or exhaust valve by a spring 33 (a third spring) which is provided between the outer body 21 and the bottom. The urging force of this spring 33 is set to be smaller than that of the valve spring 17.

The slider 32 comprises an annular groove (movable member guide groove) 321, a main body 322 whose cross section is H shape, a flange portion 323 and a stem guide portion 324.

The annular groove 321 opens in the radial direction of the slider 32. The annular groove 321 can be overlapped with the body bore 31 and has the opening width which is almost the same as axial direction width of the body bore 31. The main body portion 322 has almost the same diameter as that of the first slider guide bore 29 and the lower surface contacts with the tip portion of the valve stem 14. The flange 323 protects toward the radial direction of the slider 32 so that the lower surface of the flange 323 goes along the upper surface of the annular groove 32. The outer diameter of the flange 323 is almost the same as that of the second slider guide bore 30. The upper surface of this flange portion 323 is the receiving seat of the spring as mentioned above. The stem guide portion 324 is an annular wall which extends from the lower surface of the main body portion 322 toward the lower direction. The inner diameter of the stem guide 324 is slightly larger than the diameter of the valve stem 14; the outer diameter thereof is almost the same as that of the first slider guide bore 29. Accordingly, the valve stem 14 slides smoothly and at the same time, the stem guide portion 324 can slide in the axial direction smoothly. The slider 32 is made of abrasion material (such as carbonizing material).

Figure 3:
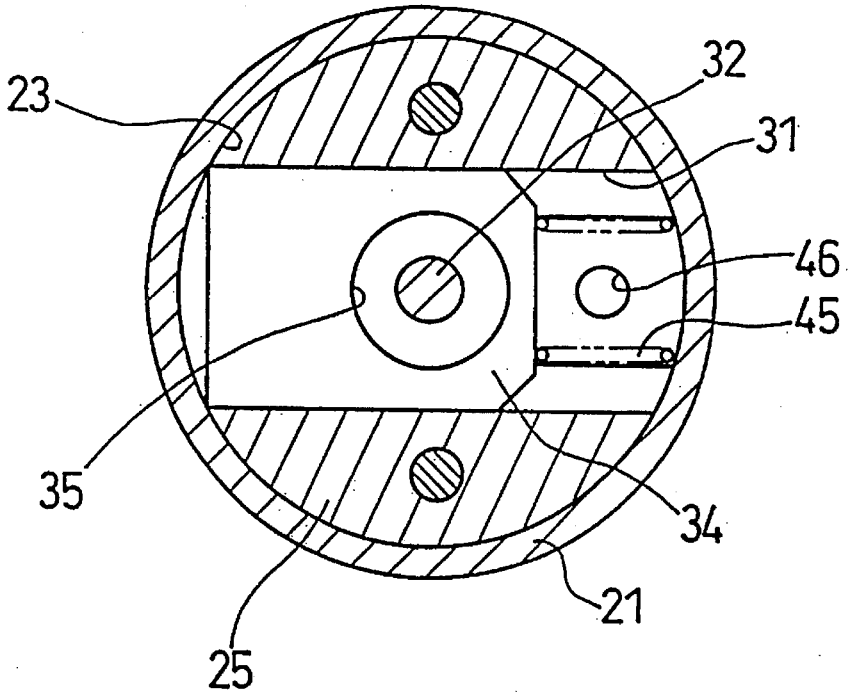
FIG. 3 is an A to A cross sectional view of FIG. 1.

In the above-mentioned body bore 31, a plate 34 is guided slidably and this plate 34 has almost the same thickness compared with the opening width of the annular groove 321 of the slider which is namely the width in the intake or exhaust valve direction of the body bore 31. In this plate 34, a through hole 35 which penetrates toward the axial direction of an intake or exhaust valve 13 is formed and the diameter of this through hole 35 is set to be almost same compared with the outer diameter of the large-diameter portion of the slider main body 322 and the outer diameter of the stem guide portion 324. The plate 34 moves from a first position (in the states of FIGS. 4 and 5) in which the plate 34 approaches into the annular groove 321 formed in the slider 32 to a second position (in the state of FIG. 1 or FIG. 3) in which the plate 34 gets out of the annular groove 321. When the plate 34 is in the first position, as shown in FIG. 5, the axial center of the through hole 35 is shifted to the axial center of the slider 32 so that slider 32 as well as valve stem 14 is incapable of being moved relative to the inner bodies 24 and 25. While the plate 34 is in the second position, the axial center of the through hole 35 corresponds to the axial center of the slider 32 so that the slider 32 as well as valve stem 14 is capable of moving relative to the inner bodies 24 and 25 as shown in FIG. 3. Furthermore, the diameter of the flange portion 323 of the slider 32 is larger than the diameter of the through hole 35 of the plate 34. Accordingly, when the plate 34 is in the second position, the flange portion 323 is in the state mounted on the plate 34. Therefore, the plate 34 can be moved from the second position toward the first position without interfering with the slider 32 and smoothly, and at the same time, the positioning of the slider 32 with the plate 34 can be conducted. The plate 34 is made of abrasion material (such as carbonizing material).

Between the left end portion of the plate 34 and the outer body 21, an oil pressure chamber 37 is formed. Through an oil pressure passage 41 formed in the cylinder head, an annular shaped groove 42 and a passage 53 formed in the outer body 21, oil pressure is supplied to the oil pressure chamber 37 by the oil supplying and discharging means 60. The oil supplying and discharging means 60 includes an electromagnetic switching valve 61, an oil pump 62 and an oil pan 63. The electromagnetic switching valve 61 of the oil pressure supplying and discharging means 60 is electrically connected with a controller (not shown) into which the operational status of the engine such as the number of revolutions and the load are inputted. The electromagnetic switching valve 61 is controlled to be opened or closed in response to the operational status of the engine by the controller. Therefore, the supplying and discharging of oil pressure to the oil pressure chamber 37 is conducted. The plate 34 can be moved from the second position shown in FIG. 4 and FIG. 5 to the first position shown in FIG. 1 or FIG. 3 by the oil pressure affected by the oil pressure chamber 37. The oil pressure in the oil pressure chamber 37 can be discharged to the oil pan through a passage 53, a hole 37*a*, a groove 42, an oil pressure passage 41 and an electromagnetic switching valve 61.

Between the passage 53 and the groove 42, a valve 50 is provided so as to block the supplying of oil pressure from the oil pressure supplying and discharging means 60 to the oil pressure chamber 37 while the outer body 21 and the inner bodies 24 and 25 are in the lowering process relative to the slider 32. The valve 50 is fitted in a bore 24*a* which is formed in the inner body 24. By a spring 52, the valve 50 is urged toward the left direction. A projection 50*a* of the valve 50 is engaged to a taper portion 51 of the bore 15*a* of the cylinder head 15. At the same time, the peripheral portion of the projection 50*a* of the valve 50 is fluid tightly engaged to the edge portion of a hole 37*a*. In this state, the pressure diameter or the pressure area of the valve 50 which are defined as the difference between the diameter of the hole 37*a* and the diameter of the projection 50*a* of the valve 50 are set to be small. In this state, even if the oil pressure is supplied to the hole 37*a*, the urging force of the spring 52 is so strong that the valve 50 is not moved toward the right direction. Through a through hole (not shown), the bore 24*a* communicates with the slider guiding hole 30 so as to be able to exhaust the leaking oil.

On the other hand, between the right end of the plate 34 and the outer body 21, the spring chamber 44 is formed. This spring chamber 44 is formed by processing both of the inner bodies 24 and 25 so as to have a width larger in the axial direction than the width in the axial direction of the body bore 31. In this spring chamber 44, a spring (a second spring) 45 is provided so that the plate 34 is urged toward the direction of reducing the volume of the oil pressure chamber 37. Here, the urging force of the spring 45 is set to be smaller than the force caused by the oil pressure. When the oil pressure is not affected in the oil pressure chamber 37, the plate 34 is kept to be in the second position shown in FIG. 3 by the pressing force of the spring 45. At the lower side inner body 25, an oil removing bore 46 is formed so as to open in the spring chamber 44 and a very small amount of oil which penetrates into the spring chamber 44 from the oil pressure chamber 37 can be discharged to the outside of the valve deactivating mechanism 20.

Furthermore, the plate 34 may be urged from the first position to the second position and at the same time the plate 34 may be urged to the second position by the spring 45.

The operation of the valve gear device 10 for an internal combustion engine according to this preferred embodiment which is constructed as above will be explained.

When the internal combustion engine starts operating, the cam shaft starts its rotation. As a result, the cam 12 is driven rotatably. First, when it is intended to open and close the intake or exhaust valve 13 constantly, as determined by the controller, the oil pressure from the oil pressure supplying and discharging means 60 is supplied to the valve 50 through the oil pressure passage 41, the groove 42 and the hole 37*a*. As shown in FIG. 1, while the inner body 24 is in the lowering process relative to the slider 32, the pressure diameter and the pressure area of the valve 50 is small, therefore, even if the oil pressure is affected by the valve 50, the oil pressure can't overcome the spring 52 which urges toward the direction of closing the valve 50 so that the oil pressure is not supplied to the oil pressure chamber 37. After a while, when the outer body 21 and the inner bodies 24 and 25 get into the lifting process to the slider 32, the projection 50*a* of the valve 50 leaves the taper portion 51. The projection 50*a* strikes the bore 15*a* and in the state of keeping the engagement between the projection 50*a* and the bore 15*a*, the valve 50 is displaced slightly in the right direction. Owing to this displacement, the annular shaped opening is formed between the projection 50*a* of the valve 50 and the hole 37*a*, and the hole 37*a* is opened. Once the hole 37*a* is opened, the oil pressure is effected on the whole front surface of the valve 50 so that it overcomes the spring 52. The valve 50 is moved in the right direction even more, and the valve 50 maintains the open state while the oil pressure continues to be supplied. The oil pressure is supplied to the plate 34 by passing through the hole 37*a* and through the passage 53. In this state, since the outer body 21 and the inner bodies 24 and 25 are downwardly moved relative to the slider 322, the plate 34 can not move so as to engage with the slider 322 and therefore the plate 34 is in a waiting state. Then, when the cam 12 is rotated and the base circle of the cam 12 contacts with the outer shim 22 again, the relative position between the inner bodies 24 and 25 and the slider 32 is in the position in which the plate 34 can engage with the slider 32. Namely, the waiting state is ended when the cam 12 returns to the base circle again. As a result, the plate 34 is moved against the urging force of the spring 45. At this time, the annular groove 321 of the slider 32 is not engaged with the plate 34 so that the plate 34 gets in contact with the outer peripheral surface of the stem guide portion 324 of the slider 32. In this state, the cam 12 rotates and inner body 24 gets in the lowering process to the slider 32. When the plate 34 and the annular groove 321 of the slider 32 are engaged, the plate 34 is pressed by the oil pressure. The plate 34 heads toward the annular groove 321 and it is moved from the second position shown in FIG. 1 to the first position shown in FIG. 4 against the urging force of the spring 45, so that a part of the plate 34 approaches the annular groove 321 formed at the slider 32 (namely, the plate 34 extends over the body hole 31 and the annular groove 321). As a result, the plate 34 stops at the first position as shown in FIG. 5 by the small diameter portion of the slider main body 322. Therefore, the relative movement between the slider 32 and the plate 34, that is, the relative movement between the slider 32, the outer body 21 and the inner bodies 24 and 24 is avoided.

Accordingly, when the cam 12 begins to get in contact with the outer shim 22 at the cam surface from the state of contacting with the outer shim 22 at the base circle as the rotation advances, the outer body 21 and inner bodies 24 and 25 as well as the slider 32 begin to go down, as shown in the Figures, against the pressing force of the valve spring 17 and the spring 26. Namely, while the outer shim 22 is engaged with the cam surface of the cam 12, the force thereof is transmitted through: the outer body 21; inner body 24; plate 34; slider 32; valve stem 14 to the intake or exhaust valve 13. An in response to the cam profile of the cam surface, the intake or exhaust valve 13 goes down, as shown in the Figures, against the pressing force of the valve spring 17 so that the intake or exhaust of air is conducted while the intake or exhaust valve 13 is apart from a sheet surface 16. At this time, the outer body may rotate in response to the cylinder bore 15*a*. However, in that case, as the outer shim 22 is in a disc shape, the cam 12 constantly engages with the outer shim 22, whereby the engaging area of the cam surface is constant.

On the other hand, when the operation of the intake or exhaust valve 13 is intended to be halted constantly, as determined by the controller, the electromagnetic switching valve 61 of the oil pressure supplying and discharging means 60 is controlled. The passage 41 communicates with the oil pan 63 so that the oil pressure in the oil pressure chamber 37 is exhausted to the oil pan 63 through the passage 53, the groove 42, the passage 41 and the electromagnetic switching valve 61. As a result, owing to the urging force of the spring 45, the plate 34 moves from the first position toward the second position, a part of the plate 34 gets out of the annular groove 321 so that as shown in FIG. 4, the plate 34 halts at the second position where the axial center of the through hole 35 of the plate 34 corresponds with the axial center of the valve stem 14, namely, the axial center of the slider 32. The position of the plate 34 is determined, as shown in FIG. 3, by contacting the left edge on the inner wall of the inner space 23 of the outer body 21. Accordingly, the relative movement between the slider 32 and the plate 34, namely between the slider 32, the outer body 21 and the inner bodies 24 and 25 can be conducted. On the other hand, the valve 50 is pressed by the spring 52 and it is moved toward the direction of closing the hole 37*a*. Owing to the hole 37*a*, the projection 50*a* projects and gets in contact with the inner wall surface of the projection bore 15*a*.

Figure 2:
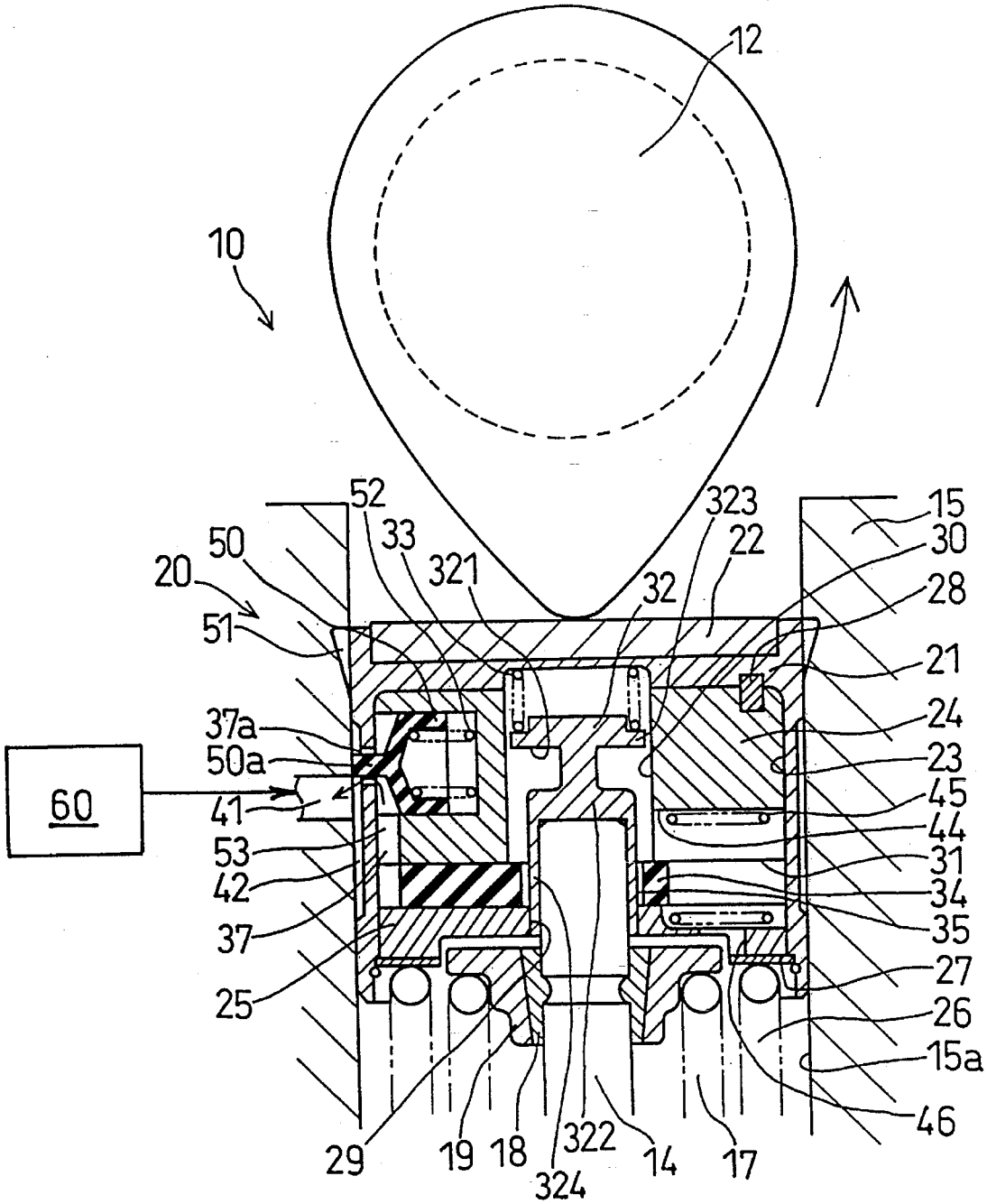
FIG. 2 is a cross sectional view showing the condition when the movable member is in the lifting process in the device shown in FIG. 1.

Therefore, as the rotation advances, even if the cam 12 begins to get in contact with the outer shim 22 at the cam surface from the state of contacting with the outer shim 22 at the base circle, the force of the cam 12 is transmitted to the outer body 21 and the inner bodies 24 and 25, but the force of the cam 12 is not transmitted to the slider 32 and the valve stem 14. That is, as the main body portion 322 of the slider 32, the stem guide portion 324 and the flange portion 323 are guided by the first slider guide bore 29, the through bore 35 and the second slider guide bore 30, respectively, the outer body 21 and the inner bodies 24 and 25 are moved against the urging force of the springs 33 and 26 downward as shown in FIG. 2. As mentioned above, the force caused by the cam 12 is not transmitted to the intake or exhaust valve 13. Therefore, the intake or exhaust valve 13 is kept in the closed state, that is, the state of sitting on the sheet surface 71 and the intake of air or the exhausting of air is not conducted. Also at this time, the first body 30 may rotate. However in that case, because the outer shim 22 is in a disc shape, the cam 12 is constantly engaged with the outer shim 22 and the area of the engaging region of the cam surface is always constant.

As shown in the above, the preferred embodiment of the present invention has the following excellent effects:

(1) The plate 34 is moved so as to cross the axial center of the stem 14 and that the relative movement of the inner bodies 24 and 25 and the slider 32 is prohibited while the outer shim 22 is in contact with the base circle of the cam 12. Accordingly, the above-mentioned regulating can be conducted at the appropriate time.

(2) The plate 34 is engaged with the stem 14 so that the relative movement among the movable members 21, 24 and 25 (the outer body 21 and the inner bodies) and the stem 14 is prevented. However, as far as the strength satisfies the predetermined value, the thickness thereof can be decreased as much as possible. Accordingly, the axial lengths of the stem 14 of the valve deactivating mechanism is not increased.

(3) Between the valve stem 14 and the plate 34 which move in the direction of crossing perpendicular to each other, the valve stem 14 is connected and also the slider whose axial center corresponds to the axial center of the stem 14 intervenes. Accordingly, the contacting of the stem 14 edge portion with the plate 34 can be avoided so that the flat abrasion of the stem 14 edge position can be controlled. Therefore, in spite of any large amount of usage, the stem 14 edge portion is not chipped and the life of the stem 14 is improved.

(4) As the slider 32 and the plate 34 are composed of anti-abrasion material, the flat abrasion of the annular groove 321 and the plate 34 can be controlled at the time of approaching the plate 34 into the annular groove 321. As a result, in spite of a large amount of usage, the annular groove 321 and the plate 34 are prevented from being chipped. Therefore, in spite of the large amount of usage, the lifting amount of the intake and exhaust valve 13 can be maintained at the appropriate amount (i.e., a constant amount).

(5) A part of the plate 34 is constructed so as to be able to approach into the annular groove 321 of the slider 32. Therefore, when the plate 34 is in the second position shown in FIG. 3, the pressing force of the valve spring 17 which acts on the valve stem 14 is just enough to be the force for pushing up the stem 14 and the slider 32 only so that the predetermined load of the valve spring 17 can be set to be small.

(6) As the plate 34 is applied, the thickness thereof is decreased so that the shaft length of the valve deactivating mechanism 20 can be shortened for that amount.

(7) The groove 321 for approaching into the plate 34 formed at the slider 32 is formed in an annular shape so that the approach of the plate 34 into the annular groove 321 can be conducted securely even if the outer body 21 and the inner bodies 24 and 25 move relative to the slider 32. Furthermore, the opening width of the annular groove 321 is set to be almost the same as the thickness of the plate 34 so that the plate 34 is prevented from shaking at the time of approaching the plate 34 into the annular groove 321.

(8) The flange portion 323 which extends to the radial direction of the slider 32 is provided at the slider 32 so that the lower surface thereof goes along the upper surface of the annular groove 321. When the plate 34 is in the second position shown in FIG. 4, the flange portion 323 is mounted on the plate 34. Accordingly, when the plate 34 is moved from the second position shown in FIG. 4 to the first position shown in FIG. 1, the interference between the plate 34 and the annular groove 321 can be avoided and the smooth sliding of the plate 34 can be conducted. Furthermore, when the plate 34 is in the second position, the slider 32 is prevented from falling down to the outside; and when the plate 34 is in the second position, the positioning of the slider 32 to the plate 34 can be conducted securely.

(9) At the slider 32, the stem guide portion 324 which guides the outer peripheral surface of the stem 14 is provided. Accordingly, the edge portion outer peripheral surface of the stem 14 is prevented from interfering with the lower side inner body 25 and the plate 34. The switching performance of the relative movement regulation is improved and at the same time, the flat abrasion of the edge portion outer peripheral surface of the stem 14 with the lower side of the inner body 25 and the plate 34 can be reduced.

(10) The outer shim 22 having the cam engaging surface is shaped in a disc. Accordingly, the cam 12 is constantly engaged with the outer shim 22 only even if the outer body 21 rotates. Even if the outer body 21 rotates, the above mentioned operation can be conducted securely. That is, the rotation preventing mechanism is unnecessary so that the flat abrasion is reduced for that amount.

(11) The outer diameter of the outer shim 22 is set to be slightly smaller than the inner diameter of the cylindrical portion which is formed at the upper surface of the outer body and which has the inner diameter larger than the diameter of the cylinder bore 15*a* so that the area of engaging to the cam 12 is secured sufficiently. As a result, the lifting amount of the cam 12 is secured.

(12) A detent 28 is provided between the outer body 21 and the upper side inner body 24 so that the relative rotation between the outer body 21 and the upper side inner body 24 is regulated. As a result, the communication between the pressure chamber 37 formed in the body bore 31 and the groove 42 formed at the outer body 21. The passage 43 can be prevented from being cut off.

Having now fully described the present invention, it will be apparent to one of ordinary skill in the art that many changes and modifications can be made thereto without departing from the spirit or scope of the present invention as set forth herein including the appended claims.

I claim:

1. A valve gear device for internal combustion engines comprising:

a stem connected to an intake or exhaust valve which opens or closes an intake or exhaust bore, respectively, that opens into a combustion chamber of an internal combustion engine;

urging means for urging said stem to maintain said intake or exhaust valve in a closed state;

a cam provided on a cam shaft; and a valve deactivating mechanism provided between said cam and said stem, wherein said valve deactivating mechanism comprises:

a cylinder bore defined in a cylinder head of said internal combustion engine and extending along an axial direction of said intake or exhaust valve;

a movable member movably engaged within said cylinder bore and operatively contacting said cam;

a relative movement regulating means for one of engaging and disengaging said stem with said movable member, said regulating means being operatively positioned to move across an axial center of said stem so as to one of prevent and allow, respectively, relative movement between said movable member and said stem;

an oil pressure supplying and discharging means for one of supplying and discharging oil pressure for said relative movement regulating means so as to one of engage and disengage said regulating means, respectively; and a valve means for controlling a flow of oil between said oil pressure supplyling and discharging means and said relative movement regulating means, wherein the flow of oil through said valve means allows movement of said relative movement regulating means after said movable member returns to an initial position after said movable member moves downwardly and then upwardly relative to said stem based on movement of said cam.

2. A valve gear device for internal combustion engines according to claim 1, wherein said valve means comprises:

a valve bore formed in said movable member and said cylinder head as an oil passage;

a valve for opening and closing said valve bore;

a driving means for opening said valve when said relative movement regulating means is not able to be engaged with said stem;

a piston for driving said valve into an open state via the oil pressure supplied through said valve bore; and an urging member for urging said piston to maintain said valve in a closed state.

3. A valve gear device for internal combustion engines according to claim 1, wherein said relative movement regulating means comprises:

an engaging plate operatively supported in said movable member so as to be movable therewithin, said engaging plate being further positioned so as to be movably driven by the oil pressure from said oil pressure supplying and discharging means, said engaging plate having defined therein a through bore; and a slider having an engaging groove defined thereon, said slider being operatively connected to said stem, said slider being slidably engaged with said through bore of said engaging plate whereby said engaging plate is movably engageable with said engaging groove.

4. A valve gear device for internal combustion engines according to claim 3, wherein said slider has defined thereon a flange portion positioned adjacent said engaging groove so as to guide and engage said engaging plate when said engaging plate engages said engaging groove.

* * * * *